US005952144A

United States Patent [19]

Hasegawa et al.

[11] Patent Number: 5,952,144

[45] Date of Patent: Sep. 14, 1999

[54] PRODUCTION PROCESS OF TONER FOR DEVELOPMENT OF ELECTROSTATIC LATENT IMAGE

[75] Inventors: Jun Hasegawa; Jun Sakai; Makoto Watanabe; Fumio Yamada; Tokudai Ogawa, all of Kanagawa, Japan

[73] Assignee: Nippon Zeon Co., Ltd., Tokyo, Japan

[21] Appl. No.: 08/973,906

[22] PCT Filed: Jun. 20, 1996

[86] PCT No.: PCT/JP96/01714

§ 371 Date: Dec. 18, 1997

§ 102(e) Date: Dec. 18, 1997

[87] PCT Pub. No.: WO97/01131

PCT Pub. Date: Jan. 9, 1997

[51] Int. Cl.[6] ..... G03G 9/093

[52] U.S. Cl. ..... 430/109; 430/137; 430/138

[58] Field of Search ..... 430/126, 137, 430/138, 109

[56] References Cited

U.S. PATENT DOCUMENTS

| | | | |
|---|---|---|---|
| 4,077,804 | 3/1978 | Vanzo . | |
| 5,153,092 | 10/1992 | Kao et al. . | |
| 5,229,243 | 7/1993 | Sasaki et al. . | |
| 5,418,109 | 5/1995 | Kanakura et al. . | |
| 5,427,885 | 6/1995 | Ota et al. . | |
| 5,567,567 | 10/1996 | Akiyama et al. | 430/138 |
| 5,712,072 | 1/1998 | Inaba et al. | 430/137 |

FOREIGN PATENT DOCUMENTS

| | | |
|---|---|---|
| 57-45558 | 3/1982 | Japan . |
| 60-173552 | 9/1985 | Japan . |
| 61-118758 | 6/1986 | Japan . |
| 2-259657 | 10/1990 | Japan . |
| 4-311966 | 11/1992 | Japan . |

OTHER PUBLICATIONS

Abstract, XP–002079418 WPI/Derwent—Abstract of JP 3 068961, Mar. 25, 1991.

Patent Abstracts of Japan, Abstract of JP 05 181301, Jul. 23, 1993.

*Primary Examiner*—John Goodrow

*Attorney, Agent, or Firm*—Armstrong, Westerman, Hattori, McLeland & Naughton

[57] ABSTRACT

A process for producing a toner for development of electrostatic latent images, which is composed of colored polymer particles and has a low fixing temperature, good permeability through OHP and excellent shelf stability, by subjecting a monomer composition containing at least a polymerizable monomer and a colorant to suspension polymerization in an aqueous dispersion medium containing a dispersing agent comprises at least two steps of:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component; and (2) the second step of adding at least one monomer for shell component, which is capable of forming a polymer having a glass transition temperature higher than that of the polymer of the core component, or a monomer composition for shell component containing said monomer, and a water-soluble radical initiator to the reaction system containing the colored polymer particles serving as the core component to conduct a polymerization reaction, thereby forming a coating layer of the polymer serving as the shell component on surfaces of the colored polymer particles serving as the core component.

25 Claims, 1 Drawing Sheet

PRODUCTION PROCESS OF TONER FOR DEVELOPMENT OF ELECTROSTATIC LATENT IMAGE

TECHNICAL FIELD

The present invention relates to a process for producing a toner for development of electrostatic latent images, and more particularly to a process for producing a toner for development of electrostatic latent images formed by electrophotography, electrostatic recording, etc.

BACKGROUND ART

Electric latent images formed by an electrophotographic apparatus, electrostatic recording apparatus or the like have heretofore been first developed with a toner. After the toner image thus formed is then transferred to a transfer medium such as paper as needed, the unfixed toner image is fixed by any of various methods such as heating, pressing and use of solvent vapor.

In general, a toner has heretofore been produced by melting and mixing a colorant, a charge control agent, an offset preventing agent and the like in a thermoplastic resin, uniformly dispersing them in the thermoplastic resin to prepare a composition, grinding the composition and then classifying the ground product. According to this production process (i.e., grinding process), a toner having a measure of excellent properties can be produced. However, there is a limit to the selection of materials for the toner. For example, the composition formed by the above melting and mixing must be such that can be ground and classified by economically usable apparatus. This requirement obliges the composition obtained by the melting and mixing to become fully brittle. For this reason, the toner obtained by such a grinding process involves the following disadvantage. When the above composition is ground into particles, the particles formed tend to have a wide particle diameter distribution. When it is intended to obtain a copy image having good resolution and gradation, therefore, fine powder having a particle diameter of 5 $\mu$m or smaller and coarse powder having a particle diameter of 20 $\mu$m or greater must be removed from the ground product by classification, so that the yield of the toner becomes very low.

Besides, in the grinding process, it is difficult to uniformly disperse solid fine particles such as the colorant, charge control agent and offset preventing agent in the thermoplastic resin. The unevenly dispersed state of the solid fine particles may form the cause that fog is increased, or image density is lowered. The uneven dispersion of these solid fine particles in the grinding process adversely affects the flowability, triboelectrification properties and the like of the resulting toner to a great extent and influences properties of the toner, such as developing characteristics and durability. Accordingly, in the grinding process, it is necessary to take good care to uniformly disperse these solid fine particles.

In order to overcome these problems in the grinding process, processes of producing a toner by suspension polymerization have been proposed in recent years. In the suspension polymerization process, a monomer composition with a polymerizable monomer, a colorant, a charge control agent, an offset preventing agent, a polymerization initiator and the like dissolved or dispersed uniformly is poured into water or an aqueous dispersion medium composed principally of water, which contains a dispersion stabilizer, and dispersed therein by means of a mixing device capable of mixing with high shearing force to form fine droplets of the polymerizable monomer composition, and the droplets are then polymerized, thereby forming toner particles (i.e., polymerized toner).

According to the suspension polymerization process, the colorant, charge control agent, offset preventing agent and the like are added to the monomer, which is a low-viscosity liquid, to disperse them therein. Therefore, a satisfactory dispersing quality compared with the grinding process, in which such components are dispersed in the resin, can be ensured. According to the suspension polymerization process, toner particles having the desired particle diameters can be generally obtained at a yield of at least 90%, and so such a process has an economical advantage over the grinding process. As described above, the problems involved in the grinding process have been able to be solved by the use of the suspension polymerization process, so that a toner, which can provide images excellent in image properties such as resolution and fog due to the extremely sharp particle diameter distribution of the polymer particles and good electric properties thereof, has been able to be produced economically.

In recent years, it has been attempted to permit reduction of demand power in copying machines, printers and the like of an electrophotographic system making use of a toner. Among the steps of the electrophotographic system, a step, in which energy is particularly demanded, is the so-called fixing step of fixing a toner after transferring the toner from a photosensitive member to a transfer medium such as paper. In the fixing step, a heating roll heated to at least 150° C. is generally used, and electric power is used as an energy source therefor. There is a demand for lowering the temperature of the heating roll from the viewpoint of energy saving. In order to lower the temperature of the heating roll, it is necessary to lower the fixing temperature of the toner itself.

In order to meet requirements from the copying machines and the like in the design of a toner, it is only necessary to lower a glass transition temperature of the toner. When the glass transition temperature of the toner is lowed, however, the toner becomes poor in the so-called shelf stability in that particles themselves of the toner tend to undergo blocking during storage, or in a toner box, to aggregate.

In the case of color toners used in the electrophotographic system on the other hand, color images have come to be often used in OHP sheets for presentations in various meetings or conferences in recent years. Therefore, the color toners have been required to have excellent permeability through OHP. In order to meet the excellent permeability through OHP, it is necessary for the toners to uniformly melt on a OHP sheet. Therefore, the melt viscosity of each toner at about the fixing temperature thereof must be designed low compared with the conventional toners. Means for lowering the melt viscosity of the toner include a method in which the molecular weight or glass transition temperature of a binder resin used is lowered compared with the binder resins for the conventional toners. In any of these methods, however, the toner becomes poor in shelf stability because the toner tends to undergo blocking.

As described above, there is an adverse correlation between the means for lowering the fixing temperature of a toner, or improving the permeability through OHP and the shelf stability of the toner. As a means for solving this adverse correlation, there has heretofore been proposed the so-called capsule type toner in which toner particles are coated with a polymer having a high glass transition temperature, thereby solving the problem of shelf stability.

As a production process of the capsule type toner, for example, Japanese Patent Application Laid-Open No.

173552/1985 has proposed a process in which a coating layer composed of a colorant, magnetic particles or a conductive agent and a binder resin is formed on the surfaces of core particles by means of a Jet mill. When core particles having a low glass transition temperature are used in this method, however, the core particles themselves tend to undergo aggregation. Accordingly, this method cannot be applied to such core particles.

Japanese Patent Application Laid-Open No. 259657/1990 has proposed a process for producing a toner for electrophotography, in which crosslinked toner particles prepared by suspension polymerization are added to a solution with an encapsulating polymer, a charge control agent and a parting agent dissolved in an organic solvent, and a poor solvent is then added to the resultant mixture to form a coating film of the encapsulating polymer containing the charge control agent and the parting agent on surfaces of the crosslinked toner particles. This process however involves a problem that since the solubility of the encapsulating polymer is reduced by the addition of the poor solvent to deposit it on the surfaces of the crosslinked toner particles, the capsule wall formed on the surface of the crosslinked toner particle becomes uneven in thickness.

Japanese Patent Application Laid-Open No. 45558/1982 has proposed a process for producing a toner for development of electrostatic latent images, in which core particles formed by polymerization are mixed and dispersed in a 1–40 wt. % aqueous latex solution, and a water-soluble inorganic salt is then added to the dispersion to form a coating layer composed of fine particles obtained by emulsion polymerization on surfaces of the core particles. However, this process has involved a drawback that the environmental dependence of charge properties of the resultant toner becomes great due to the influence of the surfactant and inorganic salt remaining on the fine particles, and in particular, the charge properties are deteriorated under high-temperature and high-humidity conditions.

DISCLOSURE OF THE INVENTION

It is an object of the present invention to provide a production process of a toner for development of electrostatic latent images, which has a low fixing temperature, good permeability through OHP and excellent shelf stability.

The present inventors have carried out an extensive investigation with a view toward overcoming the above-mentioned problems involved in the prior art. As a result, it has been found that when in the process for producing toner particles by the suspension polymerization process, a capsule type toner is produced by first forming polymer particles having a glass transition temperature not higher than 80° C. as a core component (core particles), and then adding another polymerizable monomer capable of forming a polymer having a glass transition temperature higher than that of the polymer of the core component to continue the polymerization reaction, thereby forming a coating layer of a shell component having the high glass transition temperature on the surface of the core component, the resultant capsule type toner has a low fixing temperature and good permeability through OHP and exhibits excellent shelf stability because blocking is prevented due to the existence of the shell component. A colorant is contained in the core component to form colored polymer particles.

It has also been found that upon the production of a capsule type toner by the suspension polymerization process, a process in which a monomer for shell component or a monomer composition for shell component containing said monomer, and a water-soluble radical initiator are added to the reaction system of suspension polymerization in the presence of colored polymer particles of a core component to conduct a polymerization reaction, thereby forming a coating layer of a polymer serving as the shell component on surfaces of the polymer particles of the core component, is preferred.

It has further found that when (1) a monomer for shell component or a monomer composition for shell component containing said monomer is added in the form of an aqueous suspension containing droplets having a number average particle diameter smaller than the colored polymer particles of the core component to the reaction system to conduct a polymerization reaction, or (2) an organic solvent having a solubility in water of at least 5 wt. % at 20° C. is added together with a monomer for shell component or a monomer composition for shell component containing said monomer to the reaction system in the case where a monomer having a solubility in water of lower than 0.1 wt. % at 20° C. is used as the monomer for shell component, thereby conducting polymerization, a coating layer of a polymer serving as the shell component can be efficiently formed.

The present invention has been led to completion on the basis of these findings.

In the present invention, the capsule type toner or capsule type colored polymer particles mean colored polymer particles having a core-shell structure in which a coating layer (i.e., shell component) serving as shell is formed on surfaces of colored polymer particles (i.e., core component) serving as core.

According to the present invention, there is thus provided a process for producing a toner for development of electrostatic latent images, composed of colored polymer particles, by subjecting a monomer composition containing at least a polymerizable monomer and a colorant to suspension polymerization in an aqueous dispersion medium containing a dispersing agent, which comprises at least two steps of:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component; and (2) the second step of adding at least one monomer for shell component, which is capable of forming a polymer having a glass transition temperature higher than that of the polymer of the core component, or a monomer composition for shell component containing said monomer, and a water-soluble radical initiator to the reaction system containing the colored polymer particles serving as the core component to conduct a polymerization reaction, thereby forming a coating layer of the polymer serving as the shell component on surfaces of the colored polymer particles serving as the core component, whereby capsule type colored polymer particles of a core-shell structure composed of 40–99 wt. % of the core component and 1–60 wt. % of the shell component are produced.

According to the present invention, there is also provided a process for producing a toner for development of electrostatic latent images, wherein as the above second step, at least one monomer for shell component, which is capable of forming a polymer having a glass transition temperature higher than that of the polymer of the core component, or a monomer composition for shell component containing said monomer is added in the form of an aqueous suspension containing droplets having a number average particle diameter smaller than the colored polymer particles serving as the core component to the reaction system containing the colored polymer particles serving as the core component to conduct a polymerization reaction, thereby forming a coating layer of the polymer serving as the shell component on surfaces of the colored polymer particles serving as the core component.

According to the present invention, there is further provided a process for producing a toner for development of electrostatic latent images, wherein as the above second step, an organic solvent having a solubility in water of at least 5 wt. % at 20° C. is added together with at least one monomer for shell component, which is capable of forming a polymer having a glass transition temperature higher than that of the polymer of the core component, or a monomer composition for shell component containing said monomer to the reaction system containing the colored polymer particles serving as the core component to conduct a polymerization reaction, thereby forming a coating layer of the polymer serving as the shell component on surfaces of the colored polymer particles serving as the core component.

According to the present invention, there is still further provided a toner for development of electrostatic latent images obtained by any one of the production processes described above.

According to the present invention, there is yet still further provided an image forming apparatus equipped with a receiving means containing the toner for development of electrostatic latent images obtained by any one of the production processes described above therein.

BEST MODE FOR CARRYING OUT THE INVENTION

Figure 1:
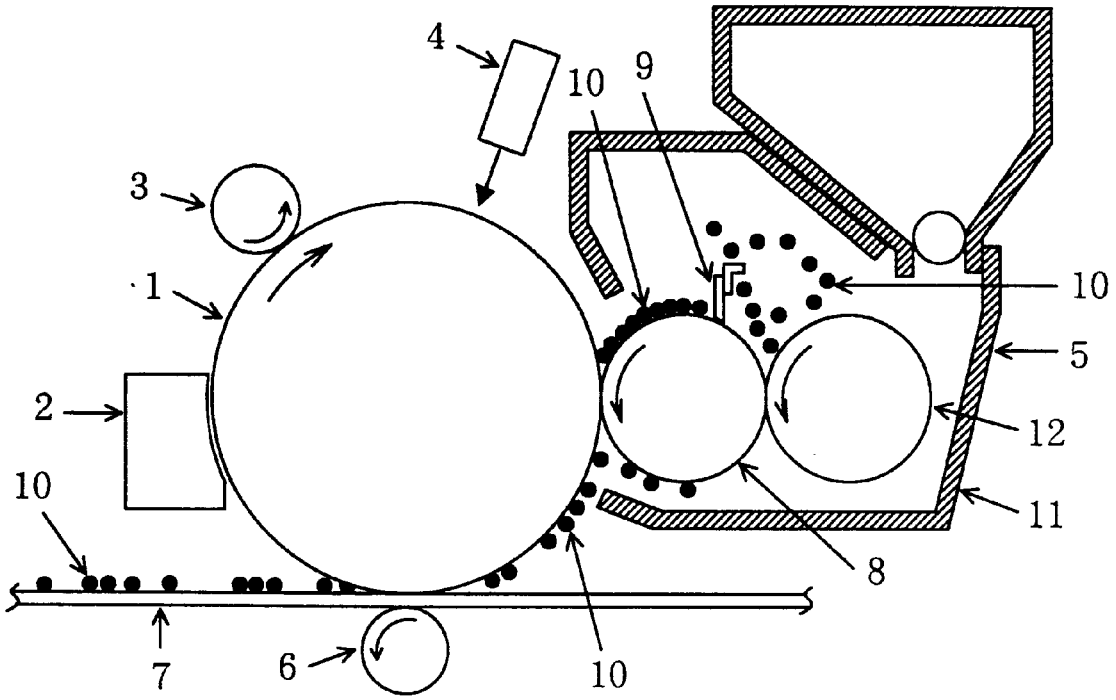
FIG. 1 is a cross-sectional view of an image forming apparatus equipped with a receiving means containing the toner for development of electrostatic latent images according to the present invention therein.

The present invention will hereinafter be described in detail.

Production process of toner

The toner for development of electrostatic latent images according to the present invention is produced by adopting the suspension polymerization process. According to the suspension polymerization process, colored polymer particles are generally produced by adding a liquid monomer mixture containing at least a polymerizable monomer and a colorant into an aqueous dispersion medium containing a dispersing agent to subject the resultant dispersion to suspension polymerization. More specifically, a colorant, a radical polymerization initiator, a charge control agent and other additives are added to a vinyl monomer to uniformly disperse them by means of a ball mill or the like, thereby preparing a liquid mixture (i.e., a monomer composition). The liquid mixture is then poured into the aqueous dispersion medium to disperse the liquid mixture in the dispersion medium by means of a mixing device capable of mixing with high shearing force, thereby forming fine droplets. The droplets are then subjected to suspension polymerization at a temperature of 30–200° C.

In order to produce the capsule type toner by the suspension polymerization process, a multi-stage polymerization process is adopted in the present invention. More specifically, in the process for producing a toner for development of electrostatic latent images, composed of colored polymer particles, by adding a monomer composition containing at least a polymerizable monomer and a colorant to an aqueous dispersion medium containing a dispersing agent to conduct suspension polymerization, the suspension polymerization is conducted by at least the following two steps:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component, and (2) the second step of adding at least one monomer for shell component, which is capable of forming a polymer having a glass transition temperature higher than that of the polymer of the core component, or a monomer composition for shell component containing said monomer, and a water-soluble radical initiator to the reaction system containing the colored polymer particles serving as the core component to conduct a polymerization reaction, thereby forming a coating layer of a polymer serving as the shell component on surfaces of the colored polymer particles serving as the core component.

By these at least two steps, capsule type colored polymer particles of a core-shell structure composed of 40–99 wt. % of the core component and 1–60 wt. % of the shell component are produced. Any additional step may be included so far as said capsule type colored polymer particles of the core-shell structure are formed.

As the above second step, there may be adopted a step of adding at least one monomer for shell component, which is capable of forming a polymer having a glass transition temperature higher than that of the polymer of the core component, or a monomer composition for shell component containing said monomer in the form of an aqueous suspension containing droplets having a number average particle diameter smaller than the colored polymer particles serving as the core component to the reaction system containing the colored polymer particles serving as the core component to conduct a polymerization reaction, thereby forming a coating layer of the polymer serving as the shell component on surfaces of the colored polymer particles serving as the core component.

Alternatively, as the above second step, there may be adopted a step of adding an organic solvent having a solubility in water of at least 5 wt. % at 20° C. together with at least one monomer for shell component, which is capable of forming a polymer having a glass transition temperature higher than that of the polymer of the core component, or a monomer composition for shell component containing said monomer to the reaction system containing the colored polymer particles serving as the core component to conduct a polymerization reaction, thereby forming a coating layer of the polymer serving as the shell component on surfaces of the colored polymer particles serving as the core component.

The glass transition temperature (Tg) of a polymer as used herein is a calculated value (referred to as calculated Tg) calculated out according to the kind(s) and proportion(s) of monomer(s) used. When the monomer used is; one, the Tg of a homopolymer formed from this monomer is defined as Tg of the polymer in the present invention. For example, the Tg of polystyrene is 100° C. Therefore, when styrene is used as a monomer by itself, the monomer is said to form a polymer having a Tg of 100° C. When monomers used are two or more, and the polymer formed is a copolymer, the Tg of the copolymer is calculated out according to the kinds and proportions of the monomers used. For example, when 60 wt. % of styrene and 40 wt. % of n-butyl acrylate are used as monomers, the monomers are said to form a polymer having a Tg of 20° C. because the Tg of a styrene-n-butyl acrylate copolymer formed at this monomer ratio is 20° C.

The definition of "at least one monomer for core component, which is capable of forming a polymer having a glass transition temperature not higher than 80° C." does not mean that when plural monomers are used, the individual monomers must always form a polymer having a Tg not higher than 80° C. When one monomer is used, the Tg of a homopolymer formed from the monomer must be not higher than 80° C. When two or more monomers are used, however, it is only necessary for the Tg of a copolymer formed from the monomer mixture to be not higher than 80° C. Therefore, those which separately form a homopolymer having a Tg higher than 80° C. may be contained in the monomer mixture. For example, although the Tg of a styrene homopolymer is 100° C., styrene may be used as a component of the monomer for core component so far as a copolymer having a Tg not higher than 80° C. can be formed by using a mixture of styrene with a monomer (for example, n-butyl acrylate) which forms a homopolymer having a low Tg. On the other hand, even if a monomer forms a polymer having a low Tg, such a monomer may be used as a component of the monomer for shell component so far as a copolymer having a high Tg can be formed by using a mixture of said monomer with a monomer which forms a homopolymer having a high Tg.

A difference in Tg between the polymer of the core component and the polymer of the shell component may be relative. For example, when the monomer for core component is such that forms a polymer having a Tg of 80° C., the monomer for shell component must be such that forms a polymer having a Tg exceeding 80° C. When the monomer for core component is such that forms a polymer having a Tg of 20° C., however, the monomer for shell component may be such that forms a polymer having a Tg of, for example, 60° C. The Tg of each polymer is a value measured by means of an ordinary measuring device such as a DSC.

In the preliminary polymerization step (first step) in which the core component is formed, at least one monomer, which forms a polymer having a Tg not higher than 80° C., is used as the monomer. Although a monomer, which yields a polymer having a low Tg, may be used by itself for adjusting the Tg, a monomer, which yields a polymer having a high Tg, and a monomer, which yields a polymer having a low Tg, are generally used in combination. The combined use of a plurality of monomers permits easy adjustment to the desired Tg. The Tg of the polymer which forms the core component is generally 0–80°, preferably 10–60° C., more preferably 15–50° C.

In the present invention, it is necessary to select a monomer, which forms the core component, in such a manner that the polymer formed from the monomer has a Tg not higher than 80° C. Fixing of a toner image to a transfer medium such as paper is commonly conducted by means of a heating roll. In order to melt the polymer of the core component as a binder resin so as to penetrate into the transfer medium in this heating and fixing step, it is necessary to preset the Tg of the polymer of the core component to 80° C. or lower. Further, in order for the image fixed to meet excellent permeability through OHP, it is necessary for the toner forming the image to uniformly melt on a OHP sheet. For that purpose, it Is preferable to adjust the Tg of the polymer of the core component to 80° C. or lower.

A colorant is contained in the monomer for core component. Besides the colorant, a radical polymerization initiator, various additives and the like may also be preferably incorporated. These components are stirred and mixed by means of a mixer capable of mixing with high shearing force to prepare a uniformly dispersed monomer composition for core component (liquid monomer mixture for core component). The monomer composition for core component is poured into an aqueous dispersion medium containing a dispersing agent to disperse it by means of a mixing device having high shearing force, thereby forming fine droplets. The droplets are then subjected to suspension polymerization at a temperature of generally 30–200° C. until the conversion of the monomer into the polymer reaches at least 80%. Polymer particles serving as the core component are formed in such a manner. If the conversion of the monomer to be formed in the core component into the polymer is lower than 80%, a comparatively great amount of the monomer for core component remains in the reaction system, so that even when the monomer for shell component or the monomer composition for shell component containing said monomer is added to conduct polymerization, it is difficult to form a shell component (coating layer) having a high Tg because the monomers for both components undergo copolymerization, and the effect by the encapsulation hence becomes insufficient. The conversion of the monomer into the polymer in the preliminary polymerization step is preferably at least 85%, more preferably at least 90%.

In the preliminary polymerization step, various kinds of dispersion stabilizers, which are in use in ordinary suspension polymerization, may be used as the dispersing agent. As the polymerization initiator, there may preferably be used oil-soluble radical polymerization initiators, which are in use in ordinary suspension polymerization, for example, 2,2-azoisobutyronitrile and the like.

In the final polymerization step (second step) in which the shell component is formed, a monomer for shell component, or a monomer composition for shell component containing said monomer (hereinafter may be referred to as a liquid monomer mixture for shell component) is added to the reaction system after the conversion of the monomer for core component into the polymer has reached at least 80%, thereby continuing the reaction. As the monomer for shell component, there is used a monomer which forms a polymer having a Tg higher than that of the polymer of the core component. As needed, various kinds of additives such as a charge control agent may be contained in the monomer for shell component to use the mixture as a monomer composition.

As the monomer which forms a polymer having a high Tg, monomers which each form a polymer having a Tg exceeding 80° C., such as styrene and methyl methacrylate, may preferably be used either singly or in any combination thereof. When the Tg of the polymer of the core component is considerably lower than 80° C., however, the monomer for shell component may be such that forms a polymer having a Tg lower than 80° C. Since a principal object of the encapsulation by the polymer of the shell component is to ensure good shelf stability of the resulting toner, the monomer for forming the shell component must be selected in such a manner that the Tg of the polymer of the shell component is at least higher than that of the polymer of the core component. The Tg of the polymer, which forms the shell component, is within a range of generally from higher than 50° C. to not higher than 120° C., preferably from higher than 60° C. to not higher than 110° C., more preferably from higher than 80° C. to not higher than 105° C. If the Tg of the polymer of the shell component is too low, the shelf stability of the resulting toner may be lowered in some cases even though the Tg is higher than that of the polymer of the core component. A difference in Tg between the polymer of the core component and the polymer of the shell component is generally at least 20° C., preferably at least 40° C., more preferably at least 50° C.

When the monomer for shell component or the monomer composition for shell component containing said monomer is added to the reaction system, the particle diameter of droplets formed from the monomer is preferably smaller than the number average particle diameter of the polymer particles which form the core component. If the number average droplet diameter of the droplets of the monomer or monomer composition for shell component is greater than the particle diameter of the polymer particles of the core component, the migration of the monomer for shell component into the polymer particles of the core component comes to be conducted only by collision with the polymer particles of the core component. The use of such great droplets is hence not efficient. On the other hand, when the number average droplet diameter of the droplets of the monomer or monomer composition for shell component is smaller than the particle diameter of the polymer particles of the core component, not only the collision of the monomer for shell component with the polymer particles of the core component, but also thermodynamic migration via the continuous medium occurs. The use of such small droplets is hence efficient. In order to add the monomer for shell component or the monomer composition for shell component in the form of fine droplets to the polymerization reaction system, it is preferable to subject a mixture of the monomer or monomer composition and an aqueous dispersion medium to a finely dispersing treatment by means of, for example, an ultrasonic emulsifier and add the monomer or monomer composition in the form of an aqueous suspension containing droplets of the monomer or monomer composition.

When the solubility of the monomer for shell component in the dispersion medium is lower than 0.1 wt. %, the droplet diameter of the monomer or monomer composition for shell component becomes several tens micrometers or greater and is commonly greater than the particle diameter of the polymer particles of the core component when it is added to the reaction system. In this case, as described above, the migration of the monomer for shell component into the polymer particles of the core component comes to be conducted only by collision with the polymer particles of the core component. The use of such great droplets is hence not efficient. In addition, it is difficult to evenly introduce the monomer for shell component into the polymer particles of the core component. Accordingly, when a monomer having a extremely low solubility in water, such as styrene, is used, it is preferable to subject the monomer or monomer composition to a finely dispersing treatment using an ultrasonic emulsifier or the like and add it in the form of an aqueous suspension containing droplets of the monomer or monomer composition.

It has been found that when the solubility of the monomer for shell component in the dispersion medium is at least 0.1 wt. %, the monomer for shell component rapidly migrates on the side of the polymer particles of the core component, which is thermodynamically stable, since an equilibrium relation grows up among droplets of the monomer or monomer composition for shell component, the polymer particles of the core component and the aqueous dispersion medium. Namely, the monomer for shell component is introduced efficiently and uniformly into the polymer particles of the core component. Accordingly, when the monomer for shell component is such that has a solubility in water of the dispersion medium of at least 0.1 wt. % (as measured at 20° C.), it is not always necessary to conduct the finely dispersing treatment by means of an ultrasonic emulsifier or the like, and so the monomer may be added to the reaction system as it is. In this case, the monomer or monomer composition for shell component may be added to the reaction system in one lot, or continuously or intermittently by means of a pump such as a plunger pump so far as the conversion of the monomer for core component into the polymer particles has reached at least 80%. Examples of monomers, which have a solubility in water of at least 0.1 wt. % at 20° C. and are suitable for use in forming the polymer of the shell component, include methyl methacrylate, acrylonitrile, vinyl acetate and acrolein. It is desirable to use these monomers either singly or in any combination thereof in such a manner that the resulting polymer will have a Tg higher than 50° C., preferably higher than 60° C., more preferably higher than 80° C.

A further investigation by the present inventors has revealed that when an organic solvent having a solubility in water of at least 5 wt. % at 20° C. is added to the aqueous dispersion medium in the second step in the present invention, an equilibrium relation grows up among droplets of the monomer or monomer composition for shell component, the polymer particles of the core component and the aqueous dispersion medium even when a monomer having a solubility in water of lower than 0.1 wt. % at 20° C. is used, and so the monomer for shell component rapidly migrates on the side of the polymer particles of the core component, which is thermodynamically stable. Namely, the monomer for shell component is introduced efficiently and uniformly into the polymer particles of the core component. The reason for that is considered to be attributable to the fact that the solubility of the monomer in the dispersion medium is enhanced to at least 0.1 wt. % by the addition of the organic solvent in the second step even when the monomer is extremely hardly water-soluble. Accordingly, when the organic solvent is added in the second step, it is not always necessary to conduct the finely dispersing treatment in advance by means of an ultrasonic emulsifier or the like before the monomer or monomer composition for shell component is added to the reaction system, and so the monomer may be added to the reaction system as it is. In this case, the monomer or monomer composition for shell component may be added to the reaction system in one lot, or continuously or intermittently by means of a pump such as a plunger pump so far as the conversion of the monomer for core component into the polymer particles has reached at least 80%.

Examples of monomers, which have a solubility in water of lower than 0.1 wt. % at 20° C. and are suitable for use in forming the polymer of the shell component, include styrene, butyl acrylate, 2-ethylhexyl acrylate, ethylene and propylene. Incidentally, even when the monomer having a solubility in water of at least 0.1 wt. % at 20° C. is used, the formation of the polymer of the shell component can be more efficiently performed by conducting the finely dispersing treatment by means of an ultrasonic emulsifier or the like or by adding the organic solvent to the reaction system. Examples of monomers, which have a solubility in water of at least 0.1 wt. % at 20° C. and are suitable for use in forming the polymer of the shell component, include methyl methacrylate, acrylonitrile, vinyl acetate and acrolein. It is desirable to use these monomers either singly or in any combination thereof in such a manner that the resulting polymer will have a Tg higher than 50° C., preferably higher than 60° C., more preferably higher than 80° C.

When the organic solvent is added to the reaction system in the second step, an organic solvent having a solubility in water of at least 5 wt. % at 20° C. is used as the organic solvent. Any organic solvent having a solubility in water of lower than 5 wt. % is difficult to enhance the solubility of the hardly water-soluble monomer in the dispersion medium. Examples of such organic solvents include lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and amides such as dimethylformamide.

The organic solvent is added in such an amount that the solubility of the monomer for shell component in the dispersion medium (total amount of water and the organic solvent) is at least 0.1 wt. %. The necessary amount of the organic solvent added varies according to the kind and amount of the monomer for shell component, the kind of the organic solvent, and the like. On the other hand, when a too great amount of the organic solvent is added to the aqueous dispersion medium, there is a possibility that the suspension polymerization reaction may be impaired. Accordingly, it is desirable that the amount of the organic solvent added be generally 0.1–50 parts by weight, preferably 0.1–40 parts by weight, more preferably 0.1–30 parts by weight per 100 parts by weight of the aqueous dispersion medium.

In the second step, the organic solvent may be added before, at the same time as or after the addition of the monomer or monomer composition for shell component. However, it is desirable to add the organic solvent to the aqueous dispersion medium prior to the addition of the monomer or monomer composition for shell component from the viewpoint of efficiency. In particular, when the monomer or monomer composition for shell component comprising a monomer having a solubility in water of lower than 0.1 wt. % at 20° C. is used, it is preferable to first add the organic solvent and further add the monomer or monomer composition for shell component to continue the polymerization reaction.

However, it is permissible to add the monomer or monomer composition for shell component comprising a monomer having a solubility in water of at least 0.1 wt. % at 20° C. to the reaction system before the addition of the organic solvent to continue the polymerization reaction, then add the organic solvent to the reaction system, and further add the monomer or monomer composition for shell component having a solubility in water of lower than 0.1 wt. % at 20° C. to continue the polymerization reaction. More specifically, according to this process, in the second step, (i) the first monomer for shell component having a solubility in water of at least 0.1 wt. % at 20° C. or the first monomer composition for shell component containing said monomer is added to the reaction system before the addition of the organic solvent to conduct a polymerization reaction, and (ii) the organic solvent and the second monomer for shell component having a solubility in water of lower than 0.1 wt. % at 20° C. or the second monomer composition for shell component containing said monomer are then add to the reaction system to conduct polymerization. According to this process, shell of a two-layer structure can be formed, whereby the fixing temperature and the like of the resulting toner can be controlled. A ratio of the first shell component to the second shell component can be suitably determined, and is generally 1:1 to 9:1 by weight.

In the second step, at the time the monomer or monomer composition for shell component is added to the polymerization reaction system, it is preferable to add a water-soluble radical initiator at the same time as or after the addition of the monomer component. When the water-soluble radical initiator is added, radicals generated in the aqueous medium enter polymer particles by collision to cause the monomer for shell component to initiate a polymerization reaction while the monomer is present in the vicinity of the surfaces of the polymer particles (namely, before the monomer for shell component is completely absorbed in the interior of the polymer particles), so that a capsule wall (shell) can be easily formed.

Examples of the water-soluble radical initiator include persulfates such as potassium persulfate and ammonium persulfate; azo initiators such as 4,4-azobis(4-cyanovaleric acid), 2,2-azobis(2-amidinopropane) bihydrochloride and 2,2-azobis-2-methyl-N-1,1-bis-(hydroxymethyl)-2-hydroxyethylpropionamide; and combinations of an oil-soluble initiator such as cumene peroxide with a redox catalyst. The amount of the water-soluble initiator used is generally 0.001–1 wt. % based on the aqueous medium. If the amount is less than 0.001 wt. %, the effect of the initiator cannot be sufficiently exhibited. If the amount exceeds 1 wt. %, particles having a particle diameter smaller than 1 $\mu$m are formed as a by-product. It is hence not preferable to use the initiator in such a small or great amount.

In the above-described manner, capsule type colored polymer particles (toner particles) composed of 40–99 wt. % of the core component and 1–60 wt. % of the shell component are produced.

Monomer

The monomer used in forming the core component in the present invention must be selected in such a manner that the Tg of a polymer to be formed from the monomer is not higher than 80° C. On the other hand, the monomer used in forming the shell component must be selected in such a manner that the Tg of a polymer to be formed from the monomer is higher than the Tg of the polymer of the core component.

In the present invention, vinyl monomers are generally used as the polymerizable monomers for core component and shell component. Various kinds of vinyl monomers are used either singly or in any combination thereof, thereby adjusting the glass transition temperatures (Tg) of the polymers of core component and shell component within the desired ranges.

Examples of the vinyl monomers used in the present invention include styrenic monomers such as styrene, vinyltoluene and a-methylstyrene; acrylic acid and methacrylic acid; acrylic acid or methacrylic acid derivatives such as methyl (meth)acrylate, ethyl (meth)acrylate, propyl (meth) acrylate, butyl (meth)acrylate, 2-ethylhexyl (meth)acrylate, dimethylaminoethyl (meth)acrylate, acrylonitrile and acrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monomers may be used either singly or in any combination thereof.

Examples of the monomer having a solubility in water of at least 0.1 wt. % at 20° C. include (meth)acrylic esters such as methyl (meth)acrylate; amides such as (meth)acrylamide;

vinyl cyanide compounds such as (meth)acrylonitrile; nitrogen-containing vinyl compounds such as 4-vinylpyridine; and vinyl acetate and acrolein. On the other hand, examples of the monomer having a solubility in water of lower than 0.1 wt. % at 20° C. include styrene, butyl acrylate, 2-ethylhexyl acrylate, ethylene and propylene.

Optional crosslinking agents may be used together with these vinyl monomers as needed. Examples of the crosslinking agents include aromatic divinyl compounds such as divinylbenzene, divinylnaphthalene and derivatives thereof; diethylenic esters of unsaturated carboxylic acids such as ethylene glycol dimethacrylate and diethylene glycol dimethacrylate; divinyl compounds such as N,N-divinylaniline and divinyl ether; and compounds having at least three vinyl groups. These crosslinking agents may be used either singly or in any combination thereof. In the present invention, the crosslinking agent is desirably used in a proportion of generally 0.1–5 parts by weight, preferably 0.3–2 parts by weight per 100 parts by weight of the vinyl monomer.

Dispersing agent

As the dispersing agent (dispersion stabilizer) used upon the suspension polymerization in the present invention, any dispersing agent, which is in use in ordinary suspension polymerization, may be used. The dispersing agents may be generally divided into water-soluble polymers which form a protective colloid to exhibit repulsive force by steric hindrance, and hardly water-soluble inorganic substances. Examples of the water-soluble polymers include polyvinyl alcohol, methyl cellulose and gelatin. Examples of the hardly water-soluble inorganic substances include hardly water-soluble salts such as calcium phosphate, barium sulfate, calcium sulfate, barium carbonate, calcium carbonate and magnesium carbonate; inorganic polymeric substances such as talc and silicic acid; metal oxides such as aluminum oxide and titanium oxide; and metal hydroxides such as aluminum hydroxide and ferric hydroxide.

As the dispersing agent, colloid of a hardly water-soluble metal hydroxide, which is formed by reacting a water-soluble polyvalent metal salt with an alkali metal hydroxide in an aqueous phase, is preferably used. The colloid of the hardly water-soluble metal hydroxide preferably has a number particle diameter distribution $D_{50}$ (50% cumulative value of number particle diameter distribution) of at most 0.5 $\mu$m and $D_{90}$ (90% cumulative value of number particle diameter distribution) of at most 1$\mu$m.

The dispersing agent is generally used in a proportion of 0.1–20 parts by weight per 100 parts by weight of the vinyl monomer. If this proportion is lower than 0.1 parts by weight, it is difficult to achieve sufficient polymerization stability, so that aggregate of the resulting polymer tend to be formed. If the proportion exceeds 20 parts by weight on the other hand, the effect of the dispersing agent on polymerization stability is saturated. Therefore, such a high proportion is not economical.

Oil-soluble polymerization initiator

As the oil-soluble polymerization initiator used in the preliminary polymerization step, any initiator may be used so far as it is soluble in the monomer used. Examples thereof include peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate, di-t-butyl peroxyisophthalate, succinamide peroxide, t-butyl peroxyisobutyrate and t-hexyl peroxy-2-ethylhexanoate; and azo compounds such as 2,2'-azobis-(2,4-dimethylvalero-nitrile), 2,2'-azobisisobutyronitrile and 1,1'-azobis(1-cyclohexanecarbonitrile).

Of these oil-soluble initiators, organic peroxides whose temperatures at which the half-lives thereof come to 10 hours (ten-hour half-life) are 60–80° C., preferably 65–80° C. and whose molecular weights are 250 or lower, particularly t-butyl peroxy-2-ethylhexanoate, are preferred because the resulting polymerized toner scarcely gives odor upon printing and barely causes environmental destruction by volatile components such as odor. If the ten-hour half-life of the oil-soluble polymerization initiator is lower than 60° C., the polymerization temperature comes to 80° C. or lower, so that the amount of the remaining monomers increases. If the ten-hour half-life exceeds 80° C., the polymerization temperature comes to 100° C. or higher, so that the polymerization vessel must be made pressure-resistant. If the molecular weight of the oil-soluble polymerization initiator exceeds 250, the molecular weight of a decomposition product from the polymerization initiator after completion of the reaction becomes higher, so that the amount of volatile components to be vaporized by drying increases and strong odor is emitted. The azo type polymerization initiators generally tend to emit strong odor. Even the polymerization initiators having a molecular weight of 250 or lower tend to increase the amount of the remaining monomers if they have an aromatic ring. The reason for it is considered to be due to the fact that when a colorant such as carbon black is present, the polymerization reaction is impeded.

These oil-soluble polymerization initiators are used in a proportion of generally 0.1–20 parts by weight, preferably 1–10 parts by weight per 100 parts by weight of the polymerizable monomer.

Examples of the colorant used in the present invention include dyes and pigments such as carbon black, Nigrosine Base, aniline blue, Chalcoil Blue, chrome yellow, ultramarine blue, Orient Oil Red, Phthalocyanine Blue and Malachite Green oxalate; and magnetic powders such as cobalt, nickel, diiron trioxide, triiron tetraoxide, manganese iron oxide, zinc iron oxide and nickel iron oxide. The dye or pigment is generally used in a proportion of 0.1–20 parts by weight, preferably 1–10 parts by weight per 100 parts by weight of the polymerizable monomer, while the magnetic powder is generally used in a proportion of 1–100 parts by weight, preferably 5–50 parts by weight per 100 parts by weight of the polymerizable monomer.

Additives

Various kinds of additives such as oil-soluble polymerization initiators, molecular weight modifiers, crosslinking agents, parting agents and charge control agents may be added to the polymerizable monomer composition (liquid monomer mixture) as needed. The oil-soluble polymerization initiators and crosslinking agents are those as described above.

Examples of the molecular weight modifiers include mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is generally used in a proportion of 0.01–10 parts by weight, preferably 0.1–5 parts by weight per 100 parts by weight of the polymerizable monomer.

Examples of the parting agents include low molecular weight polyolefins such as low molecular weight polyethylene, low molecular weight polypropylene and low molecular weight polybutylene; and paraffin waxes. The parting agent is generally used in a proportion of 0.1–20 parts by weight, preferably 1–10 parts by weight per 100 parts by weight of the polymerizable monomer.

The charge control agent is preferably contained in the polymerizable monomer composition for the purpose of improving the charge properties of the resulting toner. As the charge control agent, may be used various kinds of charge control agents for positive charge and negative charge. Specific examples of the charge control agents include Nigrosine NO1 (product of Orient Chemical Industries Ltd.), Nigrosine EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.) and Bontron E-84 (product of Orient Chemical Industries Ltd.). The charge control agent is generally used in a proportion of 0.01–10 parts by weight, preferably 0.1–5 parts by weight per 100 parts by weight of the polymerizable monomer. The combined use of the charge control agent with the monomer for shell component is preferred because the resulting toner can provide images almost free of fog.

Lubricants such as oleic acid and stearic acid; dispersion aids such as silane or titanium coupling agents; and the like may also be contained in the polymerizable monomer composition with a view toward uniformly dispersing the colorant in toner particles. Such a lubricant or dispersion aid is generally used in a proportion of about 1/1000 to 1/50 based on the weight of the colorant.

Toner for develoment of electrostatic latent images

The toner for development of electrostatic latent images is capsule type toner particles composed of 40–99 wt. %, preferably 50–95 wt. % of the core component and 1–60 wt. %, preferably 5–50 wt. % of the shell component. If the proportion of the shell component is too low, the effect of improving the shelf stability by encapsulation becomes little. If the proportion is too high on the other hand, the effects of lowering the fixing temperature and improving the permeability through OHP become little.

The toner for development of electrostatic latent images according to the present invention is composed of fine spherical particles sharp in particle diameter distribution in which the volume average particle diameter is generally 2–20 μm, preferably 3–15 μm, and the particle diameter distribution (volume average particle diameter/number average particle diameter) is generally at most 1.6, preferably at most 1.5. When the toner for development of electrostatic latent images obtained by the production process of the present invention is used, the fixing temperature can be lowered to a low temperature of 80–180° C., preferably 100–150° C. In addition, the toner does not aggregate during storage and hence has excellent shelf stability.

Image forming apparatus

The toner for development of electrostatic latent images according to the present invention is used for image forming apparatus making good use of electrophotography.

Illustrated in FIG. 1 is a cross-sectional view of an exemplary image forming apparatus. In the image forming apparatus, a photosensitive drum 1 as an image-bearing member is installed rotatably in the direction of an arrow. The photosensitive drum 1 generally has a structure that a photoconductive layer is provided around a peripheral surface of an electroconductive support drum. The photoconductive layer is composed of, for example, an organic photosensitive member, selenium photosensitive member, zinc oxide photosensitive member or amorphous silicon photosensitive member.

Around the photosensitive drum 1, a charging means 3, a latent image forming means 4, a developing means 5, a transfer means 6 and a cleaning means 2 are arranged along the circumferential direction of the drum. The charging means 3 bears an action that the surface of the photosensitive drum 1 is evenly charged either positively or negatively. Besides the charging roller illustrated in FIG. 1, for example, a corona discharge device, a charging blade or the like may be used. The latent image forming means 4 bears an action that light corresponding to image signals is applied on the predetermined pattern to the surface of the photosensitive drum evenly charged to form an electrostatic latent image on the exposed portion of the drum (reversal development system) or form an electrostatic latent image on the unexposed portion of the drum (normal development system). The latent image forming means 4 is composed of, for example, a combination of a laser device and an optical system, or a combination of an LED array and an optical system.

The developing means 5 bears an action that a developer (toner) is applied to the electrostatic latent image formed on the surface of the photosensitive drum 1. The developing means 5 is generally a developing device equipped with a development roller 8, a blade 9 for development roller, a receiving means (container casing) 11 for a developer 10 and a developer supply means (feed roller) 12. The development roller 8 is arranged in opposition to the photosensitive drum 1 and generally in close vicinity to the photosensitive drum 1 in such a manner that a part thereof comes into contact with the photosensitive drum 1, and is rotated in a direction opposite to the rotating direction of the photosensitive drum 1. The feed roller 12 is rotated in contact with and in the same direction as the development roller 8 to supply the toner 10 to the outer periphery of the development roller 8. When the development roller 8 is rotated in the developing device, the toner 10 within the developer receiving means 11 adheres to the peripheral surface of the development roller 8 owing to electrostatic force generated by friction, or the like. The blade 9 for development roller comes into contact with the peripheral surface of the rotating development roller 8 to control the layer thickness of a toner layer formed on the peripheral surface of the development roller 8. Bias voltage is applied between the development roller 8 and the photosensitive drum 1 in such a manner that the toner is caused to adhere only to a light-exposed portion of the photosensitive drum 1 in a reversal development system, or only to a light-unexposed portion of the photosensitive drum 1 in a normal development system.

The transfer means 6 serves to transfer a toner image formed on the surface of the photosensitive drum 1 by the developing means 5 to a transfer medium (transfer paper) 7. Besides the transfer roller illustrated in FIG. 1, for example, a corona discharge device, a transfer belt or the like may be used. The cleaning means 2 serves to clean off the toner remaining on the surface of the photosensitive drum 1 and is composed of, for example, a cleaning blade or the like. This cleaning means is not always required in the case of a system that cleaning action is conducted at the same time as development.

According to the present invention, there is thus provided an image forming apparatus equipped with a receiving means containing the toner for development of electrostatic latent images obtained by any one of the above-described production processes therein, a supply means for supplying the toner contained in the receiving means, an image-bearing member, a developing means provided in opposition to the image-bearing member and adapted to develop an electrostatic latent image formed on the image-bearing member with the toner supplied by the supply means, and a transfer means for transferring a toner image developed to a transfer medium.

EXAMPLES

The present invention will hereinafter be described more specifically by the following examples and comparative examples. However, the present invention is not limited to these examples only. Incidentally, all designations of "part" or "parts" and "%" as will be used in the following examples mean part or parts by weight and wt. % unless expressly noted.

Physical properties in the following examples and comparative examples were measured in accordance with the following respective methods.

(1) Particle diameter of toner

The particle diameter of each toner sample was measured in the following manner. The volume average particle diameter (dv) and particle diameter distribution, i.e., a ratio (dv/dp) of volume average particle diameter to number average particle diameter (dp) of particles were measured by means of a Coulter counter (manufactured by Coulter Co.). In the measurement by the Coulter counter, the following parameters were used.

① Aperture diameter: 100 μm;

② Medium: Isothone II;

③ By Concentration: 15%; and

④ Number of particles measured: 50,000 particles.

(2) Volume resistivity of toner

The volume resistivity of each toner sample was measured by means of a dielectric loss measuring device (TRS-10 Model, trade name; manufactured by Ando Electric Co., Ltd.) under conditions of a temperature of 30° C. and a frequency of 1 kHz.

(3) Fixing temperature of toner

A commercially available printer of a non-magnetic one-component development system was modified in such a manner that the temperature of a fixing roll can be varied. This modified printer was used to form an image with each toner sample, thereby evaluating the image. A temperature at which a fixing rate of the toner amounted to 80% was defined as a fixing temperature. The fixing test was conducted by varying the temperature of the fixing roll in the printer to determine the fixing rate at each temperature, thereby finding a relationship between the temperature and the fixing rate. The fixing rate was calculated from the ratio of image densities before and after a peeling operation using a pressure-sensitive adhesive tape, which was conducted against a black solid area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate is determined by the following equation:

$$\text{Fixing rate } (\%)=(ID_{after}/ID_{before})\times 100$$

In this test, the black solid area means an area controlled in such a manner that the toner is caused to adhere to all dots (virtual dots which control the controlling part of the printer) within this area. The peeling operation of the pressure-sensitive adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

(4) Shelf stability of toner

The evaluation of shelf stability was conducted by placing each toner sample in a closed container to seal it, sinking the container into a constant-temperature water bath the temperature of which was controlled, and then taking the container out of the water bath after a predetermined period of time went on, thereby measuring the weight of toner aggregated. The sample toner taken out of the container was transferred to a 42-mesh screen so as not to destroy the structure thereof as much as possible, and the screen was vibrated for 30 seconds with an intensity of 4.5 by means of a powder measuring device, REOSTAT (manufactured by Hosokawa Micron Corporation). Thereafter, the weight of the toner remaining on the screen was measured to regard it as the weight of the toner aggregated. The aggregation rate (wt. %) of the toner was calculated out from this weight of the aggregated toner and the weight of the sample. The shelf stability of the toner sample was evaluated by 4 ranks in accordance with the following standard:

◎: aggregation rate was lower than 5 wt. %;

○: aggregation rate was not lower than 5 wt. % but low than 10 wt. %;

Δ: aggregation rate was not lower than 10 wt. % but low than 50 wt. %; and

X: aggregation rate was not lower than 50 wt. %.

(5) Permeability through OHP

The temperature of the fixing roll in the modified printer described above was preset to 180° C. to conduct printing on a commercially available OHP sheet (Transparency, product of Uchida Yoko Co., Ltd.), thereby evaluating the permeability through OHP of each toner sample. Whether the printed image permeated through the OHP sheet or not was visually observed, thereby evaluating its permeability.

[Example 1]

Stirred and mixed at 6,000 rpm in a TK type homomixer (manufactured by Tokushu Kika Kogyo Co., Ltd.) capable of mixing with high shearing force were 60 parts of styrene, 40 parts of n-butyl acrylate, 5 parts of carbon black (Printex 150T, trade name; product of Degussa AG), 1 part of a charge control agent (Spiron Black TRH, trade name; product of Hodogaya Chemical Co., Ltd.), 0.3 parts of divinylbenzene and 2 parts of 2,2-azobisisobutyronitrile (calculated Tg of the resulting copolymer for core component=20° C.), thereby preparing a monomer composition for core component uniformly dispersed.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metal salt) dissolved in 250 parts of ion-exchanged water under stirring to prepare a dispersion of colloid (colloid of hardly water-soluble metal hydroxide) of magnesium hydroxide. The particle diameter distribution of the colloid formed was measured by means of a microtrack particle diameter distribution measuring device (manufactured by Nikkiso Co., Ltd.) and found to be 0.38 μm in terms of $D_{50}$ (50% cumulative value of number particle diameter distribution) and 0.82 μm in terms of $D_{90}$ (90% cumulative value of number particle diameter distribution). In the measurement by means of the microtrack particle diameter distribution measuring device, the following parameters were used.

Measuring range: 0.12–704 μm;

Measuring time: 30 seconds; and

Medium: ion-exchanged water.

On one hand, 10 parts of styrene (calculated Tg=100° C.) and 100 parts of water were subjected to a finely dispersing treatment by an ultrasonic emulsifier (manufactured by ULTRASONIC ENGINEERING CO., LTD.), thereby preparing an aqueous dispersion of a monomer for shell component. The droplet diameter of droplets of the monomer for shell component finely dispersed by the ultrasonic emulsifier was found to be 1.6 μm in terms of $D_{90}$ as determined by means of the microtrack particle diameter distribution measuring device by adding the droplets at a concentration of 3% to a 1% aqueous solution of sodium hexametaphosphate.

The polymerizable monomer composition for core component was then poured into the colloidal dispersion of magnesium hydroxide obtained above, and the resultant mixture was stirred at 8,000 rpm under high shearing force by means of the TK type homomixer, thereby forming droplets (monomer composition droplets) of the monomer composition for core component. The thus-prepared aqueous dispersion containing droplets of the monomer composition for core component was charged into a reactor equipped with an agitating blade to initiate a polymerization reaction at 65° C. At the time a conversion into the polymer reached 80%, the aqueous dispersion of the monomer for shell component was added to the reactor, and 1 part of a 1% aqueous solution of potassium persulfate as a water-soluble radical initiator was then added to continue the reaction for 5 hours thereafter, thereby completing the reaction to obtain an aqueous dispersion of polymer particles (toner particles). Incidentally, the number average particle diameter (dp) of the colored polymer particles of the core component at the conversion of 80% was 5.7 μm as measured according to the Coulter counter method.

The particle diameter of the toner particles after completion of the polymerization reaction was measured by the Coulter counter (manufactured by Coulter Co.). As a result, the volume average particle diameter (dv) thereof was 5.8 μm, and the particle diameter distribution thereof, i.e., a ratio (dv/dp) of the volume average particle diameter to the number average particle diameter (dp) thereof was 1.32. After the toner particles thus obtained were embedded in an epoxy resin, the embedded sample was cut into a thickness of 1 mm by an ultramicrotome, and its cut surface was observed through a transmission electron microscope. As a result, it was confirmed that shell having a thickness of 0.2 μm was formed on each toner particle.

While stirring the aqueous dispersion of the polymer particles obtained above, the pH of the system was adjusted to 4 or lower with sulfuric acid to conduct acid washing (25° C., 10 minutes). After water was separated by filtration from the dispersion, 500 parts of ion-exchanged water were newly added to form a slurry again, thereby conducting water washing. Thereafter, dehydration and water washing were conducted again repeatedly several times, followed by collection of solid matter by filtration. The solid matter was then dried at 50° C. for 24 hours by a dryer to obtain toner particles.

Added to 100 parts of the toner particles obtained above were 0.3 parts of colloidal silica (R-972, trade name; product of Nippon Aerosil Co., Ltd.) subjected to a hydrophobicity-imparting treatment, and they were mixed by means of a Henschel mixer to prepare a toner. The volume resistivity of the toner thus obtained was measured and found to be $1.0\times10^{11}\omega\cdot cm$.

The-toner thus obtained was used to measure its fixing temperature, and was found to be 130° C. The shelf stability of the toner was very good (rank=◎). The results are shown in Table 1. Besides, the evaluation of image revealed that an image high in image density, free of fog and irregularities, and extremely good in resolution was obtained.

[Example 2]

A polymerized toner was obtained in accordance with the same operating procedure as in Example 1 except that the aqueous dispersion of the monomer for shell component and the 1% aqueous solution of potassium persulfate, which were added in the course of the polymerization in Example 1, were added at the time a conversion of the monomer composition for core component into the polymer reached 93%. The measurement results of the particle diameter, fixing temperature and shelf stability of the toner particles thus obtained are shown in Table 1.

[Example 3]

A polymerized toner was obtained in accordance with the same operating procedure as in Example 1 except that amounts of styrene of the monomer for shell component and the 1% aqueous solution of potassium persulfate, which were added in the course of the polymerization in Example 1, were changed to 20 parts and 2 parts, respectively. The measurement results of the particle diameter, fixing temperature and shelf stability of the toner particles thus obtained are shown in Table 1.

[Comparative Example 1]

A polymerized toner was obtained in accordance with the same operating procedure as in Example 1 except that the aqueous dispersion of the monomer for shell component and the 1% aqueous solution of potassium persulfate, which were added in the course of the polymerization in Example 1, were not added. The measurement results of the particle diameter, fixing temperature and shelf stability of the toner particles thus obtained are shown in Table 1.

[Comparative Example 2]

A polymerized toner was obtained in accordance with the same operating procedure as in Example 1 except that a liquid mixture of 10 parts of styrene, 0.2 parts of 2,2'-azobisisobutyronitrile and 100 parts of water was added in place of the aqueous dispersion of the monomer for shell component and the 1% aqueous solution of potassium persulfate, which were added at the time the conversion of the monomer composition for core component into the polymer reached 80%. The measurement results of the particle diameter, fixing temperature and shelf stability of the toner particles thus obtained are shown in Table 1.

[Example 4]

A polymerized toner was obtained in accordance with the same operating procedure as in Example 1 except that potassium persulfate as the water-soluble radical initiator, which was added in the course of the polymerization in Example 1, was changed to 2,2-azobis-2-methyl-N-1,1-bis (hydroxymethyl)-2-hydroxyethylpropionamide. The measurement results of the particle diameter, fixing temperature and shelf stability of the toner particles thus obtained are shown in Table 1.

[Example 5]

A polymerized toner was obtained in accordance with the same operating procedure as in Example 1 except that amounts of styrene and n-butyl acrylate in the monomer composition for core component in Example 1 were changed to 75 parts of styrene and 25 parts of n-butyl acrylate (calculated Tg=44° C.). The measurement results of the particle diameter, fixing temperature and shelf stability of the toner particles thus obtained are shown in Table 1.

[Example 6]

A polymerized toner was obtained in accordance with the same operating procedure as in Example 1 except that amounts of styrene and n-butyl acrylate in the monomer composition for core component in Example 1 were changed to 55 parts of styrene and 45 parts of n-butyl acrylate (calculated Tg=10C.). The measurement results of the particle diameter, fixing temperature and shelf stability of the toner particles thus obtained are shown in Table 1.

[Example 7]

A polymerized toner was obtained in accordance with the same operating procedure as in Example 1 except that 0.001 parts of sodium dodecylbenzenesulfonate (product of Wako Pure Chemical Industries, Ltd.) were added upon subjecting the monomer for shell component, which was added in the course of the polymerization in Example 1, to the finely dispersing treatment by means of the ultrasonic emulsifier (the $D_{90}$ of the monomer droplets in the resultant fine dispersion was 0.95 $\mu$m). The measurement results of the particle diameter, fixing temperature and shelf stability of the toner particles thus obtained are shown in Table 1.

[Example 8]

A polymerized toner was obtained in accordance with the same operating procedure as in Example 1 except that 0.01 parts of a charge control agent (Bontron E-84, product of Orient Chemical Industries Ltd.) were added to the monomer for shell component, which was added in the course of the polymerization in Example 1. The measurement results of the particle diameter, fixing temperature and shelf stability of the toner particles thus obtained are shown in Table 1.

TABLE 1

| | Particle diameter of toner (dv) ($\mu$m) | Fixing temperature (° C.) | shelf stability |
|---|---|---|---|
| Example 1 | 5.8 | 130 | ◎ |
| Example 2 | 5.6 | 135 | ◎ |
| Example 3 | 6.2 | 140 | ◎ |
| Example 4 | 5.7 | 130 | ◎ |
| Example 5 | 6.1 | 138 | ◎ |
| Example 6 | 6.3 | 120 | ◎ |
| Example 7 | 5.7 | 130 | ◎ |
| Example 8 | 5.8 | 130 | ◎ |
| Comp. Ex. 1 | 5.7 | 120 | X |
| Comp. Ex. 2 | 6.0 | 125 | X |

[Example 9] (Color toner)

A polymerized toner was obtained in the same manner as in Example 1 except that 5 parts of Phthalocyanine Blue (GNX, product of Sumitomo Chemical Co., Ltd.) were used in place of carbon black in Example 1. The measurement results of the particle diameter (dv), fixing temperature, shelf stability and permeability through OHP of the toner particles thus obtained are shown in Table 2.

[Comparative Example 3]

A polymerized toner was obtained in the same manner as in Comparative Example 1 except that 5 parts of Phthalocyanine Blue (GNX, product of Sumitomo Chemical Co., Ltd.) were used in place of carbon black in Comparative Example 1. The measurement results of the particle diameter (dv), fixing temperature, shelf stability and permeability through OHP of the toner particles thus obtained are shown in Table 2.

[Comparative Example 4]

A polymerized toner was obtained in the same manner as in Comparative Example 1 except that 5 parts of Phthalocyanine Blue (GNX, product of Sumitomo Chemical Co., Ltd.) were used in place of carbon black in Comparative Example 1, and the amounts of styrene and n-butyl acrylate in the monomer composition for core component were changed to 85 parts of styrene and 15 parts of n-butyl acrylate. The measurement results of the particle diameter (dv), fixing temperature, shelf stability and permeability through OHP of the toner particles thus obtained are shown in Table 2.

TABLE 2

| | Particle diameter of toner (dv) ($\mu$m) | Fixing temperature (° C.) | Shelf stability | Permeability through OHP |
|---|---|---|---|---|
| Ex. 9 | 6.5 | 130 | ◎ | Permeable |
| Comp. Ex. 3 | 6.8 | 120 | X | Permeable |
| Comp. Ex. 3 | 6.2 | 150 | ○ | Unpermeable |

[Example 10]

In Example 10, an experimental example in which styrene of the monomer for shell component in Example 1 was changed to methyl methacrylate, and the finely dispersing treatment by means of the ultrasonic emulsifier was not conducted is described.

Stirred and mixed at 6,000 rpm in a TK type homomixer (manufactured by Tokushu Kika Kogyo Co., Ltd.) capable of mixing with high shearing force were 60 parts of styrene, 40 parts of n-butyl acrylate, 5 parts of carbon black (Printex 150T, trade name; product of Degussa AG), 1 part of a charge control agent (Spiron Black TRH, trade name; product of Hodogaya Chemical Co., Ltd.), 0.3 parts of divinylbenzene and 2 parts of 2,2-azobisisobutyronitrile (calculated Tg of the resulting copolymer for core component=20° C.), thereby preparing a monomer composition for core component uniformly dispersed.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metal salt) dissolved in 250 parts of ion-exchanged water under stirring to prepare a dispersion of colloid (colloid of hardly water-soluble metal hydroxide) of magnesium hydroxide. The particle diameter distribution of the colloid formed was measured by means of a microtrack particle diameter distribution measuring device (manufactured by Nikkiso Co., Ltd.) and found to be 0.38 $\mu$m in terms of $D_{50}$ (50% cumulative value of number particle diameter distribution) and 0.82 $\mu$m in terms of $D_{90}$ (90% cumulative value of number particle diameter distribution).

The polymerizable monomer composition for core component was then poured into the colloidal dispersion of magnesium hydroxide obtained above, and the resultant mixture was stirred at 8,000 rpm under high shearing force by means of the TK type homomixer, thereby forming droplets (monomer composition droplets) of the monomer composition for core component. The thus-prepared aqueous dispersion containing droplets of the monomer composition for core component was charged into a reactor equipped with an agitating blade to initiate a polymerization reaction at 65° C. At the time a conversion into the polymer reached 80%, 10 parts of methyl methacrylate (calculated Tg=105° C.) as a monomer for shell component were added to the reactor, and 1 part of a 1% aqueous solution of potassium persulfate as a water-soluble radical initiator was then added to continue the reaction for 5 hours thereafter, thereby completing the reaction to obtain an aqueous dispersion of polymer particles (toner particles).

The particle diameter of the toner particles after completion of the polymerization reaction was measured by the Coulter counter (manufactured by Coulter Co.). As a result, the volume average particle diameter (dv) thereof was 5.7 μm, and the particle diameter distribution thereof, i.e., a ratio (dv/dp) of the volume average particle diameter to the number average particle diameter (dp) thereof was 1.31. After the toner particles thus obtained were embedded in an epoxy resin, the embedded sample was cut into a thickness of 1 mm by an ultramicrotome, and its cut surface was observed through a transmission electron microscope. As a result, it was confirmed that shell having a thickness of 0.2 μm was formed on each toner particle.

While stirring the aqueous dispersion of the polymer particles obtained above, the pH of the system was adjusted to 4 or lower with sulfuric acid to conduct acid washing (25° C., 10 minutes). After water was separated by filtration from the dispersion, 500 parts of ion-exchanged water were newly added to form a slurry again, thereby conducting water washing. Thereafter, dehydration and water washing were conducted again repeatedly several times, followed by collection of solid matter by filtration. The solid matter was then dried at 50° C. for 24 hours by a dryer to obtain toner particles.

Added to 100 parts of the toner particles obtained above were 0.3 parts of colloidal silica (R-972, trade name; product of Nippon Aerosil Co., Ltd.) subjected to a hydrophobicity-imparting treatment, and they were mixed by means of a Henschel mixer to prepare a toner. The volume resistivity of the toner thus obtained was measured and found to be $1.5\times10^{11}\omega\cdot cm$.

The toner thus obtained was used to measure its fixing temperature, and was found to be 130° C. The shelf stability of the toner was very good (rank=◎). The results are shown in Table 3. Besides, the evaluation of image revealed that an image high in image density, free of fog and irregularities, and extremely good in resolution was obtained.

[Example 11]

A polymerized toner was obtained in accordance with the same operating procedure as in Example 10 except that methyl methacrylate and the 1% aqueous solution of potassium persulfate, which were added in the course of the polymerization in Example 10, were added at the time a conversion of the monomer composition for core component into the polymer reached 93%. The measurement results of the particle diameter, fixing temperature and shelf stability of the toner particles thus obtained are shown in Table 3.

[Example 12]

A polymerized toner was obtained in accordance with the same operating procedure as in Example 10 except that the amounts of methyl methacrylate and the 1% aqueous solution of potassium persulfate, which were added in the course of the polymerization in Example 10, were changed to 20 parts and 2 parts, respectively. The measurement results of the particle diameter, fixing temperature and shelf stability of the toner particles thus obtained are shown in Table 3.

[Example 13]

A polymerized toner was obtained in accordance with the same operating procedure as in Example 10 except that methyl methacrylate as the monomer for shell component in Example 10 was changed to acrylonitrile (calculated Tg=125° C.). The measurement results of the particle diameter, fixing temperature and shelf stability of the toner particles thus obtained are shown in Table 3.

TABLE 3

| | Particle diameter of toner (dv) (μm) | Fixing temperature (° C.) | shelf stability |
|---|---|---|---|
| Example 10 | 5.7 | 130 | ◎ |
| Example 11 | 5.8 | 140 | ◎ |
| Example 12 | 6.0 | 144 | ◎ |
| Example 13 | 6.1 | 145 | ◎ |

[Example 14]

A polymerized toner was obtained in the same manner as in Example 10 except that 5 parts of Phthalocyanine Blue (GNX, product of Sumitomo Chemical Co., Ltd.) were used in place of carbon black in Example 10. The evaluation results of this polymerized toner were as follows. The particle diameter (dv) of the toner was 5.9 μm, the fixing temperature was 130° C., the shelf stability was ranked as ◎, and the permeability through OHP was judged as permeable.

[Example 15]

Stirred and mixed at 6,000 rpm in a TK type homomixer (manufactured by Tokushu Kika Kogyo Co., Ltd.) capable of mixing with high shearing force were 60 parts of styrene, 40 parts of n-butyl acrylate, 5 parts of carbon black (Printex 150T, trade name; product of Degussa AG), 1 part of a charge control agent (Spiron Black TRH, trade name; product of Hodogaya Chemical Co., Ltd.), 0.3 parts of divinylbenzene and 2 parts of 2,2-azobisisobutyronitrile (calculated Tg of the resulting copolymer for core component=20° C.), thereby preparing a monomer composition for core component uniformly dispersed.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metal salt) dissolved in 250 parts of ion-exchanged water under stirring to prepare a dispersion of colloid (colloid of hardly water-soluble metal hydroxide) of magnesium hydroxide. The particle diameter distribution of the colloid formed was measured by means of a microtrack particle diameter distribution measuring device (manufactured by Nikkiso Co., Ltd.) and found to be 0.38 μm in terms of $D_{50}$ (50% cumulative value of number particle diameter distribution) and 0.82 μm in terms of $D_{90}$ (90% cumulative value of number particle diameter distribution). In the measurement by means of the microtrack particle diameter distribution measuring device, the following parameters were used.

Measuring range: 0.12–704 μm;

Measuring time: 30 seconds; and

Medium: ion-exchanged water.

The polymerizable monomer composition for core component was then poured into the colloidal dispersion of magnesium hydroxide obtained above, and the resultant mixture was stirred at 8,000 rpm under high shearing force by means of the TK type homomixer, thereby forming droplets (monomer composition droplets) of the monomer composition for core component. The thus-prepared aqueous dispersion containing droplets of the monomer composition for core component was charged into a reactor equipped with an agitating blade to initiate a polymerization reaction at 65° C. At the time a conversion into the polymer reached 80%, 20 parts of methanol were added. After 10 minutes, 10 parts of styrene (calculated Tg=100° C.) as a monomer for shell component were added to the reactor, and 1 part of a 1% aqueous solution of potassium persulfate was then added to continue the reaction for 5 hours thereafter, thereby completing the reaction to obtain an aqueous dispersion of polymer particles (toner particles).

The particle diameter of the toner particles after completion of the polymerization reaction was measured by the Coulter counter (manufactured by Coulter Co.). As a result, the volume average particle diameter (dv) thereof was 5.7 μm, and the particle diameter distribution thereof, i.e., a ratio (dv/dp) of the volume average particle diameter to the number average particle diameter (dp) thereof was 1.31. After the toner particles thus obtained were embedded in an epoxy resin, the embedded sample was cut into a thickness of 1 mm by an ultramicrotome, and its cut surface was observed through a transmission electron microscope. As a result, it was confirmed that shell having a thickness of 0.2 μm was formed on each toner particle.

While stirring the aqueous dispersion of the polymer particles obtained above, the pH of the system was adjusted to 4 or lower with sulfuric acid to conduct acid washing (25° C., 10 minutes). After water was separated by filtration from the dispersion, 500 parts of ion-exchanged water were newly added to form a slurry again, thereby conducting water washing. Thereafter, dehydration and water washing were conducted again repeatedly several times, followed by collection of solid matter by filtration. The solid matter was then dried at 50° C. for 24 hours by a dryer to obtain toner particles.

Added to 100 parts of the toner particles obtained above were 0.3 parts of colloidal silica (R-972, trade name; product of Nippon Aerosil Co., Ltd.) subjected to a hydrophobicity-imparting treatment, and they were mixed by means of a Henschel mixer to prepare a toner. The volume resistivity of the toner thus obtained was measured and found to be $1.8\times10^{11}\omega\cdot cm$.

The toner thus obtained was used to measure its fixing temperature, and was found to be 130° C. The shelf stability of the toner was very good (rank=◎). The results are shown in Table 4. Besides, the evaluation of image revealed that an image high in image density, free of fog and irregularities, and extremely good in resolution was obtained.

[Example 16]

A polymerized toner was obtained in accordance with the same operating procedure as in Example 15 except that styrene and the 1% aqueous solution of potassium persulfate, which were added in the course of the polymerization in Example 15, were added at the time a conversion of the monomer composition for core component into the polymer reached 93%. The measurement results of the particle diameter, fixing temperature and shelf stability of the toner particles thus obtained are shown in Table 4.

[Example 17]

A polymerized toner was obtained in accordance with the same operating procedure as in Example 15 except that the amounts of styrene and the 1% aqueous solution of potassium persulfate, which were added in the course of the polymerization in Example 15, were changed to 20 parts and 2 parts, respectively. The measurement results of the particle diameter, fixing temperature and shelf stability of the toner particles thus obtained are shown in Table 4.

[Example 18]

A polymerized toner was obtained in accordance with the same operating procedure as in Example 15 except that methanol, which was added in the course of the polymerization in Example 15, was changed to acetone. The measurement results of the particle diameter, fixing temperature and shelf stability of the toner particles thus obtained are shown in Table 4.

[Example 19]

At the time the conversion into the polymer in the first step (step of preparing the polymer particles of the core component) in Example 15 reached 80%, 10 parts of methyl methacrylate (calculated Tg=105° C.) as a monomer for the first shell component were added to the reactor, and 1 part of a 1% aqueous solution of potassium persulfate was then added to continue the reaction for 1 hour thereafter, followed by addition of 20 parts of methanol. After 10 minutes, 5 parts of styrene (calculated Tg=100° C.) as a monomer for the second shell component were added to the reactor, and 0.5 parts of a 0.5% aqueous solution of potassium persulfate were then added to continue the reaction for 5 hours thereafter, thereby completing the reaction to obtain an aqueous dispersion of polymer particles (toner particles). The measurement results of the particle diameter, fixing temperature and shelf stability of the toner particles thus obtained are shown in Table 4.

[Example 20]

A polymerized toner was obtained in accordance with the same operating procedure as in Example 15 except that 0.01 parts of a charge control agent (Bontron E-84, product of Orient Chemical Industries Ltd.) were added to styrene, which was added in the course of the polymerization in Example 15. The measurement results of the particle diameter, fixing temperature and shelf stability of the toner particles thus obtained are shown in Table 4.

[Comparative Example 5]

A polymerized toner was obtained in accordance with the same operating procedure as in Example 15 except that methanol, styrene and the aqueous solution of potassium persulfate, which were added in the course of the polymerization in Example 15, were not added. The measurement results of the particle diameter, fixing temperature and shelf stability of the toner particles thus obtained are shown in Table 4. The shelf stability of the polymerized toner was ranked as X and was poor.

TABLE 4

| | Particle diameter of toner (dv) (μm) | Fixing temperature (° C.) | shelf stability |
|---|---|---|---|
| Example 15 | 5.7 | 130 | ◎ |
| Example 16 | 5.7 | 136 | ◎ |
| Example 17 | 6.0 | 142 | ◎ |
| Example 18 | 5.9 | 140 | ◎ |
| Example 19 | 5.8 | 148 | ◎ |
| Example 20 | 5.7 | 10 | ◎ |
| Comp. Example 5 | 5.7 | 120 | X |

[Example 21]

A polymerized toner was obtained in the same manner as in Example 15 except that 5 parts of Phthalocyanine Blue (GNX, product of Sumitomo Chemical Co., Ltd.) were used in place of carbon black in Example 15. The measurement results of the particle diameter, fixing temperature, shelf stability and permeability through OHP of the toner particles thus obtained are shown in Table 5.

[Comparative Example 6]

A polymerized toner was obtained in the same manner as in Comparative Example 5 except that 5 parts of Phthalocyanine Blue (GNX, product of Sumitomo Chemical Co., Ltd.) were used in place of carbon black in Comparative Example 5. The measurement results of the particle diameter (dv), fixing temperature, shelf stability and permeability through OHP of the toner particles thus obtained are shown in Table 5.

[Comparative Example 7]

A polymerized toner was obtained in the same manner as in Comparative Example 5 except that 5 parts of Phthalocyanine Blue (GNX, product of Sumitomo Chemical Co., Ltd.) were used in place of carbon black in Comparative Example 5, and the monomer component was changed to 85 parts of styrene and 15 parts of n-butyl acrylate (calculated Tg of the copolymer=66° C.). The measurement results of the particle diameter (dv), fixing temperature, shelf stability and permeability through OHP of the toner particles thus obtained are shown in Table 5.

TABLE 5

| | Particle diameter of toner (dv) (μm) | Fixing temperature (° C.) | Shelf stability | Permeability through OHP |
|---|---|---|---|---|
| Ex. 21 | 5.9 | 130 | ◎ | Permeable |
| Comp. Ex. 6 | 6.8 | 120 | X | Permeable |
| Comp. Ex. 7 | 6.2 | 150 | ○ | Unpermeable |

[Example 22]

A polymerized toner was obtained in the same manner as in Example 15 except that t-butyl peroxy-2-ethyl-hexanoate was used as the oil-soluble initiator used in the polymerization of the monomer composition for core component in place of 2,2-azobisisobutyronitrile in Example 15, and the reaction temperature was changed to 90° C. The polymerized toner thus obtained showed substantially the same fixing temperature and shelf stability as those of the polymerized toner obtained in Example 15. The quantitative analysis of the remaining monomer was conducted in accordance with the following method. As a result, it was found that the amount of the monomer remaining in the polymerized toner of Example 15 was 690 ppm, while the amount of the monomer remaining in the polymerized toner of Example 22 was 230 ppm and reduced to a great extent. The results are shown in Table 6.

Quantitative analysis of remaining monomer

The amount of the monomer remaining in each polymerized toner sample was determined by gas chromatography. Precisely weighed out in 10-ml messflask were 0.2 g of a sample polymerized toner. After methanol was added to a bench mark, soaking was conducted for 5 hours. After insoluble matter was then precipitated by centrifugation, 1 μl of the supernatant was placed in GC-MS to analyze the sample for monomer. The conditions of GC-MS are described below.

Column: HP-1, 0.25 mm×30 m, 1 μm

Oven: heated from 50° C. to 260° C. at a heating rate of 10° C./min

INJ.: 220° C. DET.: 260° C.

[Examples 23–25]

Their corresponding polymerized toners were obtained in the same manner as in Example 22 except that the kind of the oil-soluble initiator was changed to that shown in Table 6, and the polymerization was performed at a temperature shown in Table 6. The polymerized toners thus obtained showed substantially the same fixing temperature and shelf stability as those of the polymerized toner obtained in Example 15.

The kinds of the oil-soluble initiators used, and the measurement results such as the amount of remaining monomer and judgment of odor are shown in Table 6.

TABLE 6

| | | Example | | | |
|---|---|---|---|---|---|
| | | 22 | 23 | 24 | 25 |
| Oil-soluble initiator | Kind | t-Butyl peroxy(2-ethyl hexanoate) | Succin-amide peroxide | t-Hexyl peroxy-2-ethyl-hexanoate | t-Butyl peroxyiso-butyrate |
| | 10-Hour half-life temp. (° C.) | 72 | 66 | 70 | 77 |
| | Molecular weight | 216 | 234 | 244 | 160 |
| Polymerization temp. (° C.) | | 90 | 85 | 90 | 95 |
| Polymerized state | | ○ | ○ | ○ | ○ |
| Spheroidicity | | 1.1 | 1.1 | 1.1 | 1.2 |
| Judgment of odor | | ○ | ○ | ○ | ○ |
| Water content of toner (%) | | 0.1 | 0.1 | 0.1 | 0.2 |
| Weight loss on heating (%) | | 1.1 | 1.0 | 0.8 | 0.9 |
| Remaining monomer (ppm) | | 230 | 420 | 340 | 400 |

(Note)

(1) The water content was measured by a Karl Fischer moisture meter.

(2) The weight loss on heating was determined by measuring the weight change of a sample under conditions of 105° C. for 1 hour.

(3) The judgment of odor was conducted by selecting ten panelists at random and ranking a sample as X where at least half the panelists felt odor, or ○ where none of the panelists felt odor.

INDUSTRIAL APPLICABILITY

According to the production processes of the present invention, there are provided toners for development of electrostatic latent images, which each have a low fixing temperature, good permeability through OHP and excellent shelf stability.

We claim:

1. A process for producing a toner for development of electrostatic latent images, composed of colored polymer particles, by subjecting a monomer composition containing at least a polymerizable monomer and a colorant to suspension polymerization in an aqueous dispersion medium containing a dispersing agent, which comprises at least two steps of:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component; and (2) the second step of adding at least one monomer for shell component, which is capable of forming a polymer having a glass transition temperature higher than that of the polymer of the core component, or a monomer composition for shell component containing said monomer in the form of an aqueous suspension containing droplets having a number average particle diameter smaller than the colored polymer particles serving as the core component, and a water-soluble radical initiator to the reaction system containing the colored polymer particles serving as the core component to conduct a polymerization reaction, thereby forming a coating layer of the polymer serving as the shell component on surfaces of the colored polymer particles serving as the core component, whereby capsule type colored polymer particles of a core-shell structure composed of 40–99 wt. % of the core component and 1–60 wt. % of the shell component are produced.

2. The production process according to claim 1, wherein in the second step, an organic solvent having a solubility in water of at least 5 wt. % at 20° C. is added together with the monomer for shell component or the monomer composition for shell component containing said monomer to the reaction system to conduct polymerization.

3. The production process according to claim 1, wherein the monomer for shell component is a monomer having a solubility in water of at least 0.1 wt. % at 20° C.

4. The production process according to claim 1, wherein the monomer for shell component is a monomer having a solubility in water of lower than 0.1 wt. % at 20° C.

5. The production process according to claim 1, wherein in the second step, a water-soluble radical initiator is added to the reaction system at the same time as or after the addition of the monomer for shell component or the monomer composition for shell component containing said monomer, thereby conducting polymerization.

6. The production process according to claim 1, wherein the monomer composition for shell component comprises the monomer for shell component and a charge control agent.

7. The production process according to claim 1, wherein the aqueous dispersion medium comprises colloid of a hardly water-soluble metal hydroxide, which is formed by reacting a water-soluble polyvalent metal salt with an alkali metal hydroxide in an aqueous phase, as the dispersing agent.

8. The production process according to claim 2, wherein in the second step, the organic solvent is added to the reaction system, and the monomer for shell component or the monomer composition for shell component containing said monomer is then added, thereby conducting polymerization.

9. The production process according to claim 2, wherein in the second step, (i) the first monomer for shell component having a solubility in water of at least 0.1 wt. % at 20° C. or the first monomer composition for shell component containing said monomer is added to the reaction system before the addition of the organic solvent to conduct a polymerization reaction, and (ii) the organic solvent and the second monomer for shell component having a solubility in water of lower than 0.1 wt. % at 20° C. or the second monomer composition for shell component containing said monomer are then added to the reaction system to conduct polymerization.

10. The production process according to claim 9, wherein a water-soluble radical initiator is added at the same time as or after the addition of the first monomer for shell component or the first monomer composition for shell component containing said monomer, thereby conducting polymerization.

11. The production process according to claim 9, wherein a water-soluble radical initiator is added at the same time as or after the addition of the second monomer for shell component or the second monomer composition for shell component containing said monomer, thereby conducting polymerization.

12. The production process according to claim 1, wherein in the first step, the monomer for core component is polymerized with an oil-soluble polymerization initiator.

13. The production process according to claim 1, wherein the monomer composition for core component comprises an oil-soluble polymerization initiator.

14. The production process according to claim 12, wherein the oil-soluble initiator is an organic peroxide whose ten-hour half-life temperature is 60–80° C., and whose molecular weight is 250 or lower.

15. A process for producing a toner for development of electrostatic latent images, by subjecting a monomer composition containing at least a polymerizable monomer and a colorant to suspension polymerization in an aqueous dispersion medium containing a dispersing agent, which comprises at least two steps of:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component; and (2) the second step of adding at least one monomer for shell component, which is capable of forming a polymer having a glass transition temperature higher than that of the polymer of the core component, or a monomer composition for shell component containing said monomer in the form of an aqueous suspension containing droplets having a number average particle diameter smaller than the colored polymer particles serving as the core component to the reaction system containing the colored polymer particles serving as the core component to conduct a polymerization reaction, thereby forming a coating layer of the polymer serving as the shell component on surfaces of the colored polymer particles serving as the core component, whereby capsule type colored polymer particles of a core-shell structure composed of 40–99 wt. % of the core component and 1–60 wt. % of the shell component are produced.

16. The production process according to claim 15, wherein in the first step, the monomer for core component is polymerized with an oil-soluble polymerization initiator, and in the second step, the monomer for shell component is polymerized with a water-soluble radical initiator.

17. The production process according to claim 15, wherein the monomer for shell component is a monomer having a solubility in water of lower than 0.1 wt. % at 20° C.

18. The production process according to claim 15, wherein the aqueous dispersion medium comprises colloid of a hardly water-soluble metal hydroxide, which is formed by reacting a water-soluble polyvalent metal salt with an alkali metal hydroxide in an aqueous phase, as the dispersing agent.

19. A process for producing a toner for development of electrostatic latent images, by subjecting a monomer composition containing at least a polymerizable monomer and a colorant to suspension polymerization in an aqueous dispersion medium containing a dispersing agent, which comprises at least two steps of:

(1) the first step of subjecting a monomer composition for core component containing at least one monomer for core component, which is capable of forming a polymer having a glass transition temperature not higher than 80° C., and a colorant to suspension polymerization in the aqueous dispersion medium until the conversion of the monomer into the polymer reaches at least 80%, thereby preparing colored polymer particles serving as the core component; and (2) the second step of adding an organic solvent having a solubility in water of at least 5 wt. % at 20° C. together with at least one monomer for shell component, which is capable of forming a polymer having a glass transition temperature higher than that of the polymer of the core component, or a monomer composition for shell component containing said monomer to the reaction system containing the colored polymer particles serving as the core component to conduct a polymerization reaction, thereby forming a coating layer of the polymer serving as the shell component on surfaces of the colored polymer particles serving as the core component, whereby capsule type colored polymer particles of a core-shell structure composed of 40–99 wt. % of the core component and 1–60 wt. % of the shell component are produced.

20. The production process according to claim 19, wherein in the first step, the monomer for core component is polymerized with an oil-soluble polymerization initiator, and in the second step, the monomer for shell component is polymerized with a water-soluble radical initiator.

21. The production process according to claim 19, wherein the monomer for shell component is a monomer having a solubility in water of lower than 0.1 wt. % at 20° C.

22. The production process according to claim 20, wherein the aqueous dispersion medium comprises colloid of a hardly water-soluble metal hydroxide, which is formed by reacting a water-soluble polyvalent metal salt with an alkali metal hydroxide in an aqueous phase, as the dispersing agent.

23. The production process according to claim 20, wherein in the second step, (i) the first monomer for shell component having a solubility in water of at least 0.1 wt. % at 20° C. or the first monomer composition for shell component containing said monomer is added to the reaction system before the addition of the organic solvent to conduct a polymerization reaction, and (ii) after the organic solvent is then added to the reaction system, the second monomer for shell component having a solubility in water of lower than 0.1 wt. % at 20° C. or the second monomer composition for shell component containing said monomer is added to conduct polymerization.

24. A toner for development of electrostatic latent images obtained by the production process according to any one of claims 1, 2–23.

25. An image forming apparatus equipped with ① a receiving means containing the toner for development of electrostatic latent images according to claim 24 therein, ② a supply means for supplying the toner contained in the receiving means, ③ an image-bearing member, ④ a developing means provided in opposition to the image-bearing member and adapted to develop an electrostatic latent image formed on the image-bearing member with the toner supplied by the supply means, and ⑤ a transfer means for transferring a toner image developed to a transfer medium.

* * * * *